US007682195B2

(12) United States Patent
Yuan et al.

(10) Patent No.: US 7,682,195 B2
(45) Date of Patent: Mar. 23, 2010

(54) ELECTRICAL CONNECTOR WITH METALLIC SHELL

(75) Inventors: Wei Yuan, Shenzhen (CN); Yu-San Hsiao, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/464,899

(22) Filed: May 13, 2009

(65) Prior Publication Data

US 2009/0286423 A1 Nov. 19, 2009

(30) Foreign Application Priority Data

May 13, 2008 (CN) ..... 2008 2 0116883

(51) Int. Cl.
*H01R 13/648* (2006.01)

(52) U.S. Cl. ..... 439/607.35; 439/95

(58) Field of Classification Search ..... 439/607.3, 439/607.35, 95, 607.55
See application file for complete search history.

(56) References Cited

U.S. PATENT DOCUMENTS 7,059,875 B2 * 6/2006 Kunimoto ..... 439/95
7,314,379 B2 * 1/2008 Chen et al. ..... 439/95
2005/0026501 A1 * 2/2005 Zhan et al. ..... 439/607
2008/0038959 A1 * 2/2008 Barringer et al. ..... 439/607

FOREIGN PATENT DOCUMENTS

CN 201038454 Y 3/2008

* cited by examiner

*Primary Examiner*—Hien Vu
(74) *Attorney, Agent, or Firm*—Wei Te Chung; Andrew C. Cheng; Ming Chieh Chang

(57) ABSTRACT

An electrical connector comprises an insulative housing defining a lengthwise slot, a plurality of terminals received in the insulative housing and extending into the lengthwise slot, a metal shell, and an EMI gasket. The metal shell comprises a body portion with a front insertion port and a detachable metal cover, the body portion defines a hollow to receive the insulative housing. The body portion comprises a top wall defining a through window and a bottom wall defining a through opening, the metal cover covers the window of the body portion, and the EMI gasket is located between the body portion and the metal board portion for suppressing electro magnetic interference.

8 Claims, 3 Drawing Sheets

ELECTRICAL CONNECTOR WITH METALLIC SHELL

BACKGROUND OF THE INVENTION

1. Field of the Invention

The present invention relates to an electrical connection device, and more particularly to an electrical connector with a metallic shell shielding a pair of connector therein.

2. Description of Related Art

CN Pat. No. 201038454 issued to TIAN-QING CAI on Mar. 19, 2008, discloses an electrical connector comprising an insulative housing defining a lengthwise slot, a plurality of terminals received in the insulative housing and extending into the lengthwise slot, and a metallic shell. The metallic shell comprises a body portion with a front opening for insertion of a mating connector, the body portion defining a hollow space to receive the insulative housing and a detachable metallic cover. The body portion comprises a top wall defining a window and a bottom wall defining a opening, the detachable metallic cover shields the window of the body portion. There is between the body portion and the cover a space, through which EMI emissions may leak out. Thus, the effective suppression of electromagnetic emissions remains a challenge.

Hence, an improved electrical connector is required to overcome the disadvantages of the prior art.

SUMMARY OF THE INVENTION

Accordingly, an object of the present invention is to provide an electrical connector assembly with an improved shielding structure to suppress electro magnetic interference.

In order to achieve the above-mentioned object, an electrical connector comprises an insulative housing defining a lengthwise slot, a plurality of terminals received in the insulative housing and extending into the lengthwise slot, a metallic shell, and an EMI gasket. The metal shell comprises a body portion with a front opening and a detachable metallic cover, the body portion defines a space to receive the insulative housing. The body portion comprises a top wall defining a window and a bottom wall defining a opening, the metallic cover covers the window of the body portion, and the EMI gasket is located between the body portion and the metal board portion for suppressing electro magnetic interference.

Other objects, advantages and novel features of the present invention will become more apparent from the following detailed description of the present embodiment when taken in conjunction with the accompanying drawings.

DETAILED DESCRIPTION OF THE INVENTION

Figure 1:
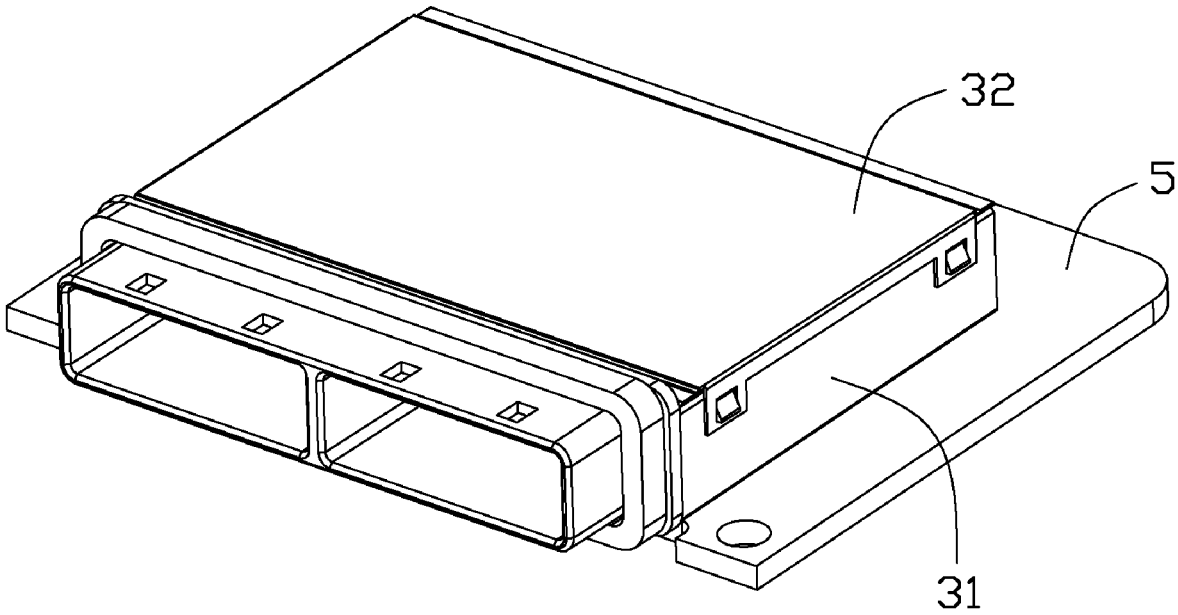
FIG. 1 is an assembled, perspective view of an electrical connector according to an embodiment of the present invention.
Figure 2:
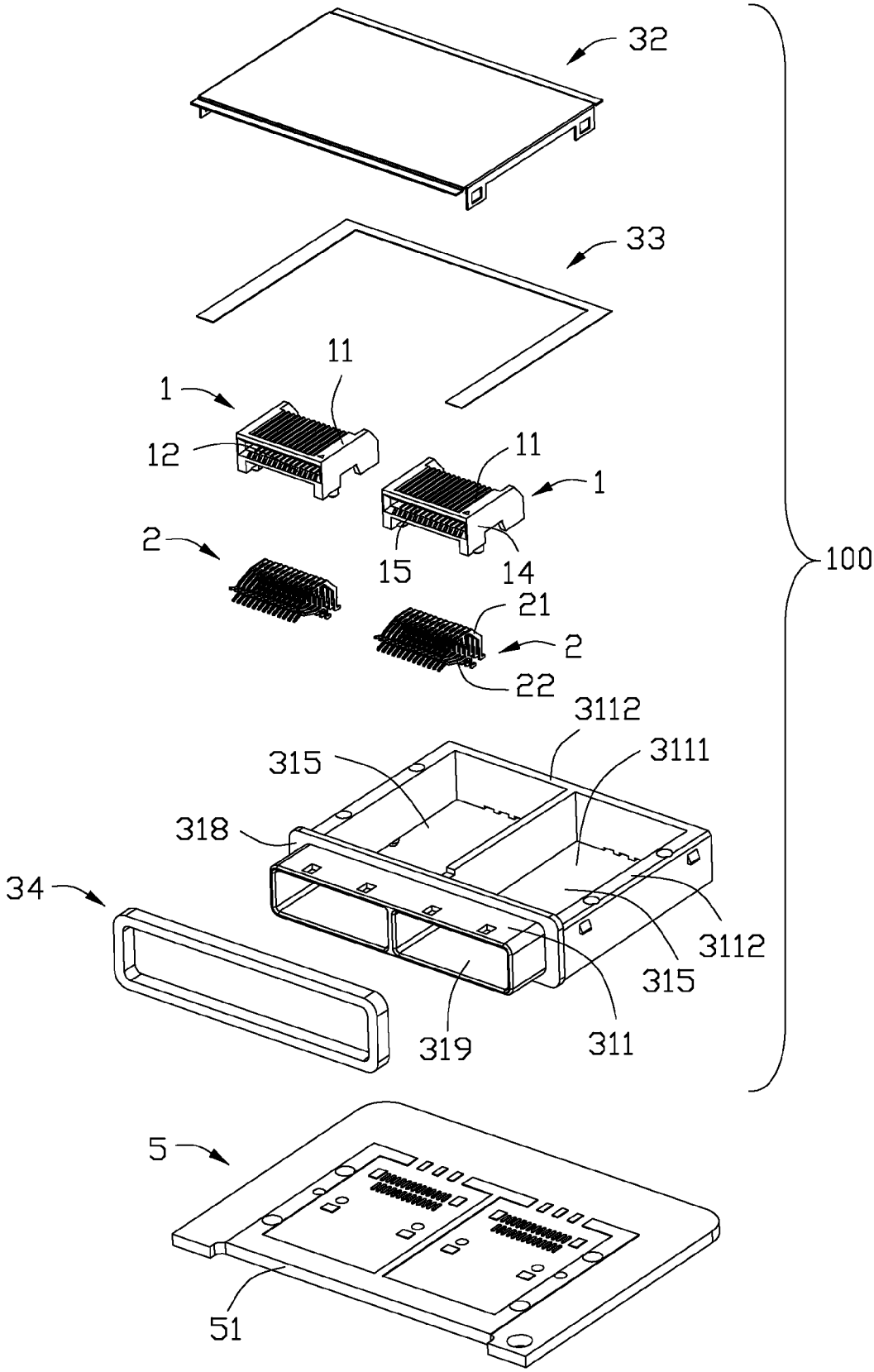
FIG. 2 is an exploded, perspective view of the electrical connector of FIG 1.
Figure 3:
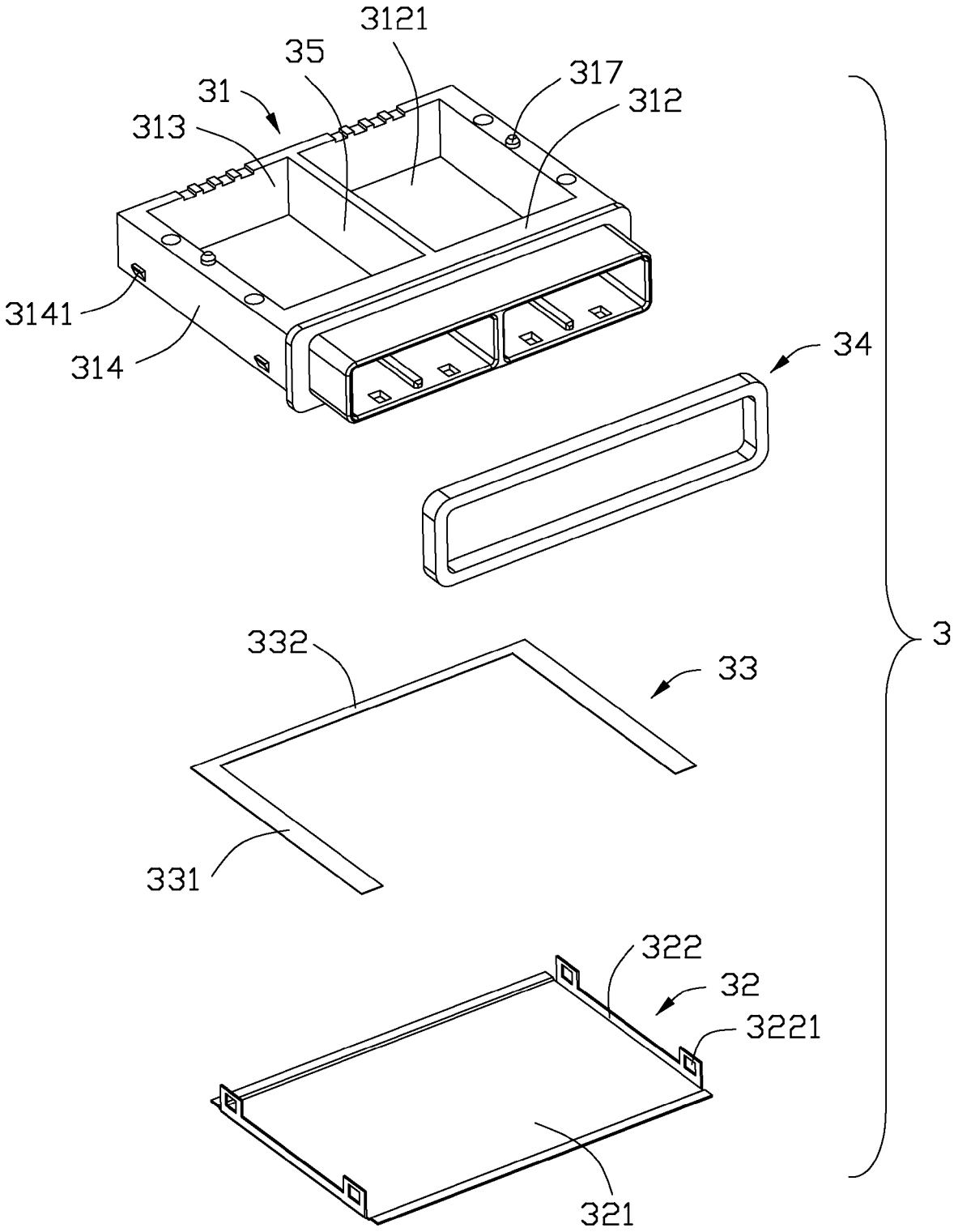
FIG. 3 is another perspective view of the metal shell of FIG. 2.

Referring to FIG. 1 to 2, an electrical connector 100 for providing a connection between a printed circuit board 5 and a complementary connector (not shown, according to an embodiment of the present invention is shown to comprise an insulative housing 1 defining a lengthwise slot 15, a plurality of terminals 2 received in the insulative housing 1 and extending into the lengthwise slot 15, a metal shell 3.

The insulative housing 1 comprises an upper wall 11, a lower wall 12, a rear wall and a pair of side wall 14. The upper wall 11, the lower wall 12, the pair of side wall 14 and the rear wall cooperatively defining a lengthwise slot 15. The terminals 2 which are assembled to the insulative housing 1 are arranged into a first group of terminals 21 and a second group of terminals 22, the first group of terminals 21 are assembled to the insulated housing 1 along a front-to-back direction and the second group of terminals 22 are assembled to the insulated housing 1 along a vertical direction perpendicular to the front-to-back direction.

The metal shell 3 comprises a body portion 31 and a detachable metallic cover 32 assembled to the body portion 31. The body portion 31 includes an upper wall 311 defining a window 3111, a lower wall 312 defining a opening 3121, a back wall 3 13 and a pair of transversal walls 314. The upper wall 311, the lower wall 312 and the back wall 313 and the pair of the transversal walls 314 jointly defines a receiving space 315 for receipt of the insulative housing 1 therein, the space 315 communicates with the opening 3121 and the window 3111. A continues ridge 318 divides the metal shell 3 into a front opening 319 and a back receiving part. The metal cover 32 covers the window 3111 of the body portion 31, and the EMI gasket 33 is located between the body portion 31 and the metallic cover 32 for suppressing electro magnetic interference.

The body portion 31 defines peripheral edge sections 3112, the metallic cover 32 defines a back section 332 and a pair of side sections 331 abutting against peripheral edge sections 3112 respectively.

The outer surface of each transversal wall 314 forms a pair of tabs 3141. The metallic cover 32 has a panel portion 321 for covering the window 306 and two pairs of ear portions 322 respectively extending downwardly from two sides of the panel portion 321. Each ear portion 322 defines a pair of holes 3221 therein for locking with corresponding tab 3141 formed on the outer surface of the transversal wall 314. A gasket 34 for suppressing electro magnetic interference is assembled to the metallic shell 3 and abuts against the continuous ridge 318 of the metal shell 3. The gasket 34 and EMI gasket 33 may be fabricated of conductive rubber or metal.

In the embodiment of the present invention, the metallic shell 3 receives two insulative housings 1, the two insulative housings 1 are spaced by a partition 35 extending along a front-to-back direction.

When assembly, the first group of terminal 21 are assembled to the insulative housing 1 along a front-to-back direction. While, the second group of terminals 22 are assembled to the insulative housing 1 from bottom thereof along a vertical direction perpendicular to the front-to-back direction. Secondly, the insulative housing 1 is mounted to the printed circuit board 5. Thirdly, the body portion 31 of the metal shell 3 is mounted to the printed circuit board 5, with the insulative housing 1 inserted the space 315 through the opening 3121, the positioning post 317 protruding into the holes (not labeled) of the printed circuit board 5, the continuous ridge 318 abutting against a positioning cutout 51. Fourthly, the EMI gasket 33 is assembled to the peripheral edge sections 3112 of the body portion 31. Fifthly, the metal cover 32 is assembled to the body portion 31 of the metal shell 3, with the panel portion 321 shielding the window 3111 and the holes 3221 of the ear portions 322 interferentially locking with the tabs 311 of the transversal wall 314.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector comprising:

insulative housings each defining a lengthwise slot;

a plurality of terminals received in the insulative housing and extending into the lengthwise slot;

a metallic shell comprising: a body portion with a front opening, said body portion defining a space having a middle partition therein to receive the insulative housings, the body portion comprising a top wall defining a window and a bottom wall defining an opening;

a detachable metallic cover covering the window of the body portion; and an EMI gasket positioned on edges of the top wall and located between the body portion and the metal cover for suppressing electro magnetic interference;

wherein the body portion defines peripheral edge sections, and wherein the metal cover defines a back section and a pair of side sections abutting against peripheral edge sections respectively;

wherein a gasket for suppressing an electro magnetic interference is assembled to the metallic shell and abuts against a continuous ridge of the body portion;

wherein the gasket and EMI gasket are fabricated of conductive rubber or metal; and wherein the terminals are arranged into a first group of terminals and a second group of terminals, and wherein the first group of terminals and the second group of terminals are assembled to the insulated housing along different directions which are perpendicular to each other.

2. The electrical connector as claimed in claim 1, wherein the body portion comprises a pair of transversal walls interconnecting the top wall and the bottom wall.

3. The electrical connector as claimed in claim 2, wherein the metallic cover has a panel portion for shielding the window and at least a pair of ear parts respectively extending downwardly from the two sides of the panel portion, and wherein each ear part defines a hole therein for locking with corresponding tab formed on the outer surface of the transversal wall.

4. The electrical connector as claimed in claim 1, wherein the first group of terminals are assembled to the insulated housing along a front-to-back direction and the second group of terminals are assembled to the insulated housing along a vertical direction perpendicular to the front-to-back direction.

5. The electrical connector as claimed in claim 1, wherein the metallic shell receives two insulative housings, which are spaced by a partition along a front-to-back direction.

6. An electrical connector assembly for providing a connection between a printed circuit board and a complementary connector, said printed circuit board having a plurality of conductive traces disposed thereon, comprising:

insulative housings each defining a lengthwise slot;

a plurality of terminals received in the insulative housing and extending into the lengthwise slot;

a metallic shell comprising: a body portion with a front opening and a back receiving part having a middle partition therein, said back receiving part including an upper wall defining a through window, a lower wall defining a through opening, a back wall and a pair of transverse walls, wherein the upper wall, the lower wall and the back wall and the pair of the transverse walls jointly defines a receiving cavity for receipt of the insulative housings;

a detachable metal cover covering the window of the body portion; and an EMI gasket positioned on edges of the top wall and located between the body portion and the metal cover for suppressing electro magnetic interference;

wherein the front insertion port of the body portion has a continuous ridge adapted for abutting against a positioning cutout of the printed circuit board;

wherein the gasket and EMI gasket are fabricated of conductive rubber or metal; and wherein the terminals are arranged into a first group of terminals and a second group of terminals, and wherein the first group of terminals and the second group of terminals are assembled to the insulated housings along different directions which are perpendicular to each other.

7. An electrical connector assembly comprising;

a printed circuit board defining first and second mounting areas side by side arranged with each other on an upper surface thereof;

a metal shell mounted upon the first and second mounting areas and including a single body portion divided by a middle partition to define first and second receiving cavities corresponding to said first and second mounting areas, respectively;

a detachable metal cover mounted upon the body portion opposite to the printed circuit board; and first and second connectors mounted upon the first and second mounting areas and received in the first and second receiving cavities, respectively; wherein the printed circuit board defines first mounting holes within the corresponding first and second mounting areas to receive corresponding mounting posts of the connectors, and second mounting holes in a boundary of said first and second mounting areas to receive corresponding mounting posts of the body portion;

an EMI gasket positioned on edges of a top wall of the body portion and located between the body portion and the metal cover for suppressing electro magnetic interference;

wherein the body portion defines first and second front opening communicating with the corresponding first and second receiving cavities, respectively;

wherein a grounding trace extends along the boundary on the printed circuit board for engagement with a bottom of the body portion; and wherein the body portion defines a flange around the front opening, and the printed circuit board defines a cutout in a front edge to receive said flange so as to allow the tight engagement between a bottom of the body portion and the printed circuit board.

8. The electrical connector assembly as claimed in claim 7 wherein a rear wall of the body portion defines at least one notch at a bottom edge thereof for heat dissipation.

* * * * *